United States Patent [19]

Schulz

[11] 4,032,607

[45] June 28, 1977

[54] PROCESS FOR PRODUCING SELF-BONDED WEBS OF NON-WOVEN CARBON FIBERS

[75] Inventor: David Arthur Schulz, Fairview Park, Ohio

[73] Assignee: Union Carbide Corporation, New York, N.Y.

[22] Filed: Sept. 27, 1974

[21] Appl. No.: 510,128

[52] U.S. Cl. ..... 264/29.3; 156/148; 156/155; 156/327; 264/6; 264/126; 264/DIG. 19; 423/447.1; 423/447.4

[51] Int. Cl.[2] ..... B29C 6/00; B29C 25/00; D01F 9/12

[58] Field of Search ..... 264/29, DIG. 19, 6, 264/126, 29.2, 29.3; 423/447, 448, 447.1, 447.4; 117/44, 226; 252/502, 504, 516; 427/227, 228, 249; 156/327, 148, 155; 428/367, 368

[56] References Cited

UNITED STATES PATENTS

| | | | |
|---|---|---|---|
| 1,289,892 | 12/1918 | Perry | 264/171 |
| 2,184,316 | 12/1939 | Plummer | 264/DIG. 75 |
| 2,571,457 | 10/1951 | Ladisch | 264/DIG. 75 |
| 3,011,981 | 12/1961 | Soltes | 264/DIG. 19 |
| 3,035,308 | 5/1962 | Ragoss et al. | 264/29 |
| 3,517,092 | 6/1970 | Peterson | 264/29 |
| 3,558,276 | 1/1971 | Otani | 264/29 |
| 3,668,110 | 6/1972 | Shea et al. | 208/45 |
| 3,718,493 | 2/1973 | Joo et al. | 106/273 R |
| 3,769,144 | 10/1973 | Economy et al. | 161/50 |
| 3,787,541 | 1/1974 | Grindstaft et al. | 264/29 |
| 3,917,806 | 11/1975 | Amagi et al. | 264/29 |
| 3,919,376 | 11/1975 | Schulz | 264/29 |
| 3,927,187 | 12/1975 | Luhleich et al. | 264/29 |
| 3,971,669 | 7/1976 | Wrzesien et al. | 156/148 |

OTHER PUBLICATIONS

II. Biennial Conf. on Carbon Extended Abstract and Prog. Am. Carbon Committee, (1973), pp. 216–217, by Yamada et al.

*Primary Examiner*—Jay H. Woo
*Attorney, Agent, or Firm*—John S. Piscitello

[57] ABSTRACT

Self-bonded webs of non-woven carbon fibers in the form of blankets, felt, paper, fiberboard, and the like, are produced by spinning a carbonaceous pitch having a mesophase content of from about 40 percent by weight to about 90 percent by weight to form carbonaceous pitch fiber; disposing staple lengths of the spun fiber in intimately contacting relationship with each other in a non-woven fibrous web; heating the web produced in this manner in an oxidizing atmosphere to thermoset the surfaces of the fibers to an extent which will allow the fibers to maintain their shape upon heating to more elevated temperatures but insufficient to thermoset the interior portions of the fibers; heating the web containing the externally thermoset fibers under compressive pressure in an oxygen-free atmosphere to a temperature sufficiently elevated to cause the mesophase pitch in the unoxidized interior portions of the fibers to undergo liquid flow and exude through surface pores or flaws in the fibers and contact the surfaces of the adjacent fibers; and further heating the web to a carbonizing temperature in an oxygen-free atmosphere so as to expel hydrogen and other volatiles and produce a carbon body wherein the fibers are bonded to each other by infusible carbon bonds.

19 Claims, No Drawings

PROCESS FOR PRODUCING SELF-BONDED WEBS OF NON-WOVEN CARBON FIBERS

BACKGROUND OF THE INVENTION

1. Field of the Invention

This invention relates to self-bonded webs of non-woven carbon fibers in the form of blankets, felt, paper, fiberboard, and the like.

2. Description of the Prior Art

Non-woven webs of carbon fiber, such as carbon fiber felt or batting, are known in the art and have been described in the literature, e.g., by Wessendorf et al. in U.S. Pat. No. 3,844,877. However, the nature of such webs requires that they be bonded together by some form of binder in order to form useful products. The requirement of a binder, and the processing difficulties attendant its use, however, renders the use of such products commercially unattractive.

SUMMARY OF THE INVENTION

In accordance with the present invention, it has now been discovered that webs composed of non-woven carbonaceous fibers disposed in intimately contacting relationship can be prepared, and the fibers thereof bonded to each other by infusible carbon bonds without the addition of any external binder, by spinning a carbonaceous pitch having a mesophase content of from about 40 percent by weight to about 90 percent by weight of form cabonaceous pitch fiber, disposing staple lengths of the spun fiber in intimately contacting relationship with each other in a non-woven fibrous web, heating the web produced in this manner in an oxidizing atmosphere to thermoset the surfaces of the fibers to an extent which will allow the fibers to maintain their shape upon heating to more elevated temperatures but insufficient to thermoset the interior portions of the fibers, heating the web containing the externally thermoset fibers under compressive pressure in an oxygenfree atmosphere to a temperature sufficiently elevated to cause the mesophase pitch in the unoxidized interior portions of the fibers to undergo liquid flow and exude through surface pores or flaws in the fibers and contact the surfaces of the adjacent fibers, and further heating the web to a carbonizing temperature in an oxygen-free atmosphere so as to expel hydrogen and other volatiles and produce a carbon body wherein the fibers are bonded to each other by infusible carbon bonds.

DESCRIPTION OF THE PREFERRED EMBODIMENTS

While carbonaceous fibers can be spun fron non-mesophase pitches, only mesophase pitches are employed in the present invention because of their ability to produce highly-oriented, high-modulus, high-strength fibers which can be easily thermoset. Mesophase pitches are pitches which have been transformed, in whole or in part, to a liquid crystal or so-called mesophase state. Such pitches by nature contain highly oriented molecules, and when these pitches are spun into fibers, the pitch molecules are preferentially aligned by the spinning process along the longitudinal axis of the fiber to produce a highly oriented fiber.

Mesophase pitches can be produced in accordance with known techniques by heating a natural or synthetic carbonaceous pitch having an aromatic base in an inert atmosphere at a temperature of above about 350° C. for a time sufficient to produce the desired quantity of mesophase. When such a pitch is heated in this manner under quiescent conditions, either at constant temperature or with gradually increasing temperature, small insoluble liquid spheres begin to appear in the pitch which gradually increase in size as heating is continued. When examined by electron diffraction and polarized light techniques, these spheres are shown to consist of layers of oriented molecules aligned in the same direction. As these spheres continue to grow in size as heating is continued, they come in contact with one another and gradualy coalesce with each other to produce larger masses of aligned layers. As coalescence continues, domains of aligned molecules much larger than those of the original spheres are formed. These domains come together to form a bulk mesophase wherein the transition from one oriented to another sometimes occurs smoothly and continuously through gradually curving lamellae and sometimes through more sharply curving lamellae. The differences in orientation between the domains create a complex array of polarized light extinction contours in the bulk mesophase corresponding to various types of linear discontinuity in molecular alignment. The ultimate size of the oriented domains produced is dependent upon the viscosity, and the rate of increase of the viscosity, of the mesophase from which they are formed, which, in turn are dependent upon the particular pitch and the heating rate. In certain pitches domains having sizes in excess of 200 microns and as large as several thousand microns are produced. In other pitches, the viscosity of the mesophase is such that only limited coalescence and structural rearrangement of layers occur, so that the ultimate domain size does not exceed one hundred microns.

The highly oriented, optically anisotropic, insoluble material produced by treating pitches in this manner has been given the term mesophase, and pitches containing such material are known as mesophase pitches. Such pitches, when heated above their softening points, are mixtures of two immiscible liquids, one the optically anisotropic, oriented mesophase portion, and the other the isotropic non-mesophase portion. The term mesophase is derived from the Greek "mesos" or "intermediate" and indicates the pseudo-crystalline nature of this highly-oriented, optically anisotropic material.

Carbonaceous pitches having a mesophase content of from about 40 percent by weight to about 90 percent by weight are suitable for producing the highly oriented carbonaceous fibers from which the self-bonded webs of the present invention can be produced. In order to obtain the desired fiber from such pitch, however, the mesophase contained therein must, under quiescent conditions, form a homogeneous bulk mesophase having large coalesced domains, i.e., domains of aligned molecules in excess of 200 microns. Pitches which form stringy bulk mesophase under quiescent conditions, having small oriented domains, rather than large coalesced domains, are unsuitable. Such pitches form mesophase having a high viscosity which undergoes only limited coalescence, insufficient to produce large coalesced domains having sizes in excess of 200 microns. Instead, small oriented domains of mesophase agglomerate to produce clumps or stringy masses wherein the ultimate domain size does not exceed one hundred microns. Certain pitches which polymerize very rapidly are of this type. Likewise, pitches which do not form a homogeneous bulk mesophase are unsuitable. The latter phenomenon is caused by the presence of infusible solids (which are either present in the original pitch or which develop on heating) which are enveloped by the coalescing mesophase and serve to interrupt the homogeneity and uniformity of the coalesced domains, and the boudaries between them.

Another requirement is that the pitch be non-thixotropic under the conditions employed in the spinning of the pitch into fibers, i.e., it must exhibit a Newtonian or plastic flow behavior so that the flow is uniform and well behaved. When such pitches are heated to a temperature where they exhibit a viscosity of from about 10 poises to about 200 poises, uniform fibers may be readily spun therefrom. Pitches, on the other hand, which do not exhibit Newtonian or plastic flow behavior at the temperature of spinning, do not permit uniform fibers to be spun therefrom.

Carbonaceous pitches having a mesophase content of from about 40 percent by weight to about 90 percent by weight can be produced in accordance with known techniques, as aforesaid, by heating a natural or synthetic carbonaceous pitch having an aromatic base in an inert atmosphere at a temperature above about 350° C. for a time sufficient to produce the desired quantity of mesophase. By an inert atmosphere is meant an atmosphere which does not react with the pitch under the heating conditions employed, such as nitrogen, argon, xenon, helium, and the like. The heating period required to produce the desired mesophase content varies with the particular pitch and temperature employed, with longer heating periods required at lower temperatures than at higher temperatures. At 350° C., the minimum temperature generally required to produce mesophase, at least one week of heating is usually necessary to produce a mesophase content of about 40 percent. At temperatures of from about 400° C. to 450° C., conversion to mesophase proceeds more rapidly, and a 50 percent mesophase content can usually be produced at such temperatures within about 1–40 hours. Such temperatures are preferred for this reason. Temperatures above about 500° C. are undesirable, and heating at this temperature should not be employed for more than about 5 minutes to avoid conversion of the pitch to coke.

The degree to which the pitch has been converted to mesophase can readily be determined by polarized light microscopy and solubility examinations. Except for certain non-mesophase insolubles present in the original pitch or which, in some instances, develop on heating, the non-mesophase portion of the pitch is readily soluble in organic solvents such as quinoline and pyridine, while the mesophase portion is essentially insoluble. [1] In the case of pitches which do not develop non-mesophase insolubles when heated, the insoluble content of the heat treated pitch over and above the insoluble content of the pitch before it has been heat treated corresponds essentially to the mesophase content. [2] In the case of pitches which do develop non-mesophase insolubles when heated, the insoluble content of the heat treated pitch over and above the insoluble content of the pitch before it has been heat treated is not solely due to the conversion of the pitch to mesophase, but also represents non-mesophase insolubles which are produced along with the mesophase during the heat treatment. Pitches which contain infusible non-mesophase insolubles (either present in the original pitch or developed by heating) in amounts sufficient to prevent the development of homogeneous bulk mesophase are unsuitable for producing highly oriented carbonaceous fibers useful in the present invention, as noted above. Generally, pitches which contain in excess of about 2 percent by weight of such infusible materials are unsuitable. The presence or absence of such homogeneous bulk mesophase regions, as well as the presence or absence of infusible non-mesophase insolubles, can be visually observed by polarized light microscopy examination of the pitch (see, e.g., Brooks, J. D., and Taylor, G. H., "The Formation of Some Graphitizing Carbons," *Chemistry and Physics of Carbon*, Vol. 4, Marcel Dekker, Inc., New York, 1968, pp. 243–268; and Dubois, J., Agache, C., and White, J. L., "The Carbonaceous Mesophase Formed in the Pyrolysis of Graphitizable Organic Materials," Metallography 3, pp. 337–369, 1970). The amounts of each of these materials may also be visually estimated in this manner.

[1] The percent of quinoline insolubles (Q.I.) of a given pitch is determined by quinoline extraction at 75° C. The percent of pyridine insolubles (P.I.) is determined by Soxhlet extraction in boiling pyridine (115° C.).

[2] The insoluble content of the untreated pitch is generally less than 1 percent (except for certain coal tar pitches) and consists largely of coke and carbon black found in the original pitch.

Aromatic base carbonaceous pitches having a carbon content of from about 92 percent by weight to about 96 percent by weight and a hydrogen content of from about 4 percent by weight to about 8 percent by weight are generally suitable for producing mesophase pitches which can be employed to produce the fibers useful in the instant invention. Elements other than carbon and hydrogen, such as oxygen, sulfur and nitrogen, are undesirable and should not be present in excess of about 4 percent by weight. When such extraneous elements are present in amounts of from about 0.5 percent by weight to about 4 percent by weight, the pitches generally have a carbon content of from about 92–95 percent by weight, the balance being hydrogen.

Petroleum pitch, coal tar pitch and acenaphthylene pitch are preformed starting materials for producing the mesophase pitches which are employed to produce the fibers useful in the instant invention. Petroleum pitch can be derived from the thermal or catalytic cracking of petroleum fractions. Coal tar pitch is similarly obtained by the destructive distillation of coal. Both of these materials are commercially available natural pitches in which mesophase can easily be produced, and are preferred for this reason. Acenaphyhylene pitch, on the other hand, is a synthetic pitch which is preferred because of its ability to produce excellent fibers. Acenaphthylene pitch can be produced by the pyrolysis of polymers of acenaphthylene as described by Edstrom et al. in U.S. Pat. No. 3,574,653.

Some pitches, such as fluoranthene pitch, polymerize very rapidly when heated and fail to develop large coalesced domains of mesophase, and are, therefore, not suitable precursor materials. Likewise, pitches having a high infusible non-mesophase insoluble content in organic solvents such as quinoline or pyridine, or those which develop a high infusible non-mesophase insoluble content when heated, should not be employed as starting materials, as explained above, because these pitches are incapable of developing the homogeneous bulk mesophase necessary to produce highly oriented carbonaceous fibers. For this reason, pitches having an infusible quinoline-insoluble or pyridine-insoluble content of more than about 2 percent by weight (determined as described above) should not be employed, or should be filtered to remove this material before being heated to produce mesophase. Preferably, such pitches are filtered when they contain more than about 1 percent by weight of such infusible, insoluble material. Most petroleum pitches and synthetic pitches have a low infusible, insoluble content and can be used directly without such filtration. Most coal tar pitches, on the other hand, have a high infusible, insoluble content and require filtration before they can be employed.

As the pitch is heated at a temperature between 350° C. and 500° C. to produce mesophase, the pitch will, of course, pyrolyze to a certain extent and the composition of the pitch will be altered, depending upon the temperature, the heating time, and the composition and structure of the starting material. Generally, however, after heating a carbonaceous pitch for a time sufficient to produce a mesophase content of from about 40 percent by weight to about 90 percent by weight, the resulting pitch will contain a carbon content of from about 94–96 percent by weight and a hydrogen content of from about 4–6 percent by weight. When such pitches contain elements other than carbon and hydrogen in amounts of from about 0.5 percent by weight to about 4 percent by weight, the mesophase pitch will generally have a carbon content of from about 92–95 percent by weight, the balance being hydrogen.

After the desired mesophase pitch has been prepared, it is spun into fiber by conventional techniques, e.g., by melt spinning, centrifugal spinning, blow spinning, or in any other known manner. As noted above, in order to obtain highly oriented carbonaceous fibers from which the self-bonded webs of the present invention can be produced the pitch must, under quiescent conditions, form a homogeneous bulk mesophase having large coalesced domains, and be non-thixotropic under the the conditions employed in the spinning. Further, in order to obtain uniform fibers from such pitch, the pitch should be agitated immediately prior to spinning so as to effectively intermix the immiscible mesophase and non-mesophase portions of the pitch.

The temperature at which the pitch is spun depends, of course, upon the temperature at which the pitch exhibits a suitable viscosity, and at which the higher-melting mesophase portion of the pitch can be easily deformed and oriented. Since the softening temperature of the pitch, and its viscosity at a given temperature, increases as the mesophase content of the pitch increases, the mesophase content should not be permitted to rise to a point which raises the softening point of the pitch to excessive levels. For this reason, pitches having a mesophase content of more than about 90 percent are generally not employed. Pitches containing a mesophase content of from about 40 percent by weight to about 90 percent by weight, however, generally exhibit a viscosity of from about 10 poises to about 200 poises at temperatures of from about 310° C. to above about 450° C. and can be readily spun at such temperatures. Preferably, the pitch employed has a mesophase content of from about 45 percent by weight to about 75 percent by weight, most preferably from about 55 percent by weight to about 75 percent by weight, and exhibits a viscosity of from about 30 poises to about 150 poises at temperatures of from about 340° C. to about 440° C. At such viscosity and temperature, uniform fibers having diameters of from about 10 microns to about 20 microns can be easily spun. As previously mentioned, however, in order to obtain the desired fibers, it is important that the pitch be nonthixotropic and exhibit Newtonian or plastic flow behavior during the spinning of the fibers.

The carbonaceous fibers produced in this manner are highly oriented materials having a high degree of preferred orientation of their molecules parallel to the fiber axis, as shown by their X-ray diffraction patterns. This preferred orientation is apparent from the short arcs which constitute the (002) bands of the diffraction pattern. Microdensitometer scanning of the (002) bands of the exposed X-ray film indicate this preferred orientation to be generally from about 20° to about 35°, usually from about 25° to about 30° (expressed as the fully width at half maximum of the azimuthal intensity distribution).

After the fiber has been spun, staple lengths of the fiber are formed into a non-woven web wherein the staple fiber lengths are disposed in intimately contacting relationship with each other. Preferably the staple fiber lengths are produced by blow-spinning of the pitch, and the blow-spin fibers are disposed into a web directly from the spinnerette. This can be conveniently accomplished by positioning a screen in the vicinity of the spinnerette and reducing the pressure behind the screen so as to draw the blow-spun fibers onto the screen. The fibers are preferably deposited on the screen so as to produce a web having an areal density of about 0.05 – 0.5 kg./m$^2$ of screen surface. The screen employed is preferably in the form of an endless wire mesh conveyor belt which can be used to transport the web through an oxidizing atmosphere.

Alternatively, continuous fiber can be spun and then cut or chopped into a desired length before being processed to form a web. Any method, either wet or dry, which effects the disposition of such fibers in intimately contacting relation in a non-woven fibrous web can be employed. Air laying operations, such as carding or garnetting, which effect a relatively oriented disposition of fibers are suitable for this purpose. When a more random disposition of fibers is desired, conventional textile devices which effect the air laying of fibers in a random webbing can be employed.

The fibers can also be formed into a web by water laying the fibers using conventional paper making techniques. When such techniques are employed, the fibers are first cut to a length suitable for processing, e.g., about ¼ inch in length, homogeneously intermixed with water and a suitable binder, such as starch or other well known binder, to form an aqueous slurry, and then deposited from the slurry on a substrate to form a web. Generally, the web is formed either by running a dilute suspension of fibers onto the surface of a moving endless belt of wire cloth, through which excess water may be drawn, or by running an endless belt or wire cloth through a suspension of the fibers. In the first case, a part of the water is drawn off by gravity, a part is taken from the web by suction, and a part is removed by pressure. In the second case, a vacuum is maintained below the stock level in the cylinder in which the wire cloth is rotating and the web forms on the wire by suction. In either case, the thickness of the web is controlled by the speed of the conveyor belt, by the consistency of the fiber suspension, and by the amount of suspension permitted to flow onto the belt.

After the non-woven fibrous web has been formed, it is heated in an oxidizing atmosphere for a time sufficient to thermoset the surfaces of the fibers of the web to an extent which will allow the fibers to maintain their shape upon heating to more elevated temperatures but insufficient to thermoset the pitch in the interior portions of the fibers to an extent which will prevent the pitch from flowing and exuding through surface pores or flaws in the fibers upon such further heating. Generally, thermosetting of the fibers to an oxygen content of from about 1 percent by weight to about 6 percent by weight is usually sufficient to allow the fibers to maintain their shape and at the same time not prevent the pitch in the interior portions of the fibers from flowing and exuding through surface pores or flaws in the fibers upon further heating at more elevated temperatures. Upon such further heating, small droplets of molten pitch exude from the fibers at intervals along the fiber lengths and contact the surfaces of the adjacent fibers. By applying pressure to the web during such heating to effect greater fiber-to-fiber contact, this bleeding effect can be conveniently utilizing to bond the fibers together into a cohesive, self-bonded mass. When the web is then further heated to a carbonizing temperature in an oxygen-free atmosphere so as to expel hydrogen and other volatiles and produce a carbon body, infusible carbon bonds are produced between the fibers.

As noted above, the non-woven fibrous web is preferably produced by blow-spinning staple lengths of fiber and collecting the blow-spun fibers on an endless wire mesh conveyor belt which can be used to transport the web through an oxidizing atmosphere. By varying the speed of this belt it is possible to expose the web to the oxidizing atmosphere for any desired length of time and thereby thermoset the fibers contained therein to any desired degree. The extent to which the fibers are oxidized, of course, will determine the degree to which they will bleed when heated to a temperature sufficiently elevated to cause the mesophase pitch in the unoxidized interior portions of the fibers to undergo liquid flow, i.e., the degree to which the pitch will exude through surface pores or flaws in the fibers. If desired, an oxidizing oven containing a number of zones having processively higher temperature can be employed so as to allow the fibers to be gradually heated to the desired final oxidizing temperature. Because the oxidation reaction is an exothermic one, and hence difficult to control, the oven is suitably a convection oven in which the oxidizing atmosphere may be passed through the web and wire mesh conveyor belt so as to remove heat of reaction from the immediate vicinity of the fibers and maintain a more constant temperature. The oxidizing gas, of course, may be recirculated through the oven after passing through the web and conveyor belt. To help maintain the web securely against the belt and prevent the fibers from blowing around in the oven, the oxidizing gas should be circulated downward through the web and belt rather than upward. The rate of flow of the gas, as well as the temperature, should be independently controlled in each zone of the oven to allow temperature and gas flow through the web to be regulated as desired. Gas velocity through the web is suitably maintained at a rate of from about 1 to about 10 feet per minute. The temperature of the zones is maintained, e.g., at from about 175° C. in the first or entrance zone up to about 400° C. in the last or exit zone.

The oxidizing atmosphere employed to thermoset the fibers of the non-woven webs of the present invention may be pure oxygen, nitric oxide, or any other appropriate oxidizing atmosphere. Most conveniently, air is employed as the oxidizing atmosphere.

The time required to thermoset the surface of the fibers will, of course, vary with such factors as the particular oxidizing atmosphere, the temperature employed, the diameter of the fibers, the particular pitch from which the fibers are prepared, and the mesophase content of such pitch. Generally, however, thermosetting can be effected in relatively short periods of time, usually in from about 5 minutes to less than about 60 minutes.

The temperature employed to effect thermosetting of the fibers must, of course, not exceed the termperature at which the fibers will soften or distort. The maximum temperature which can be employed will thus depend upon the particular pitch from which the fibers were spun, and the mesophase content of such pitch. The higher the mesophase content of the fiber, the higher will be its softening temperature, and the higher the temperature which can be employed to effect thermosetting. At higher temperatures, of course, thermosetting can be effected in less time than is possible at lower temperatures. Fibers having a lower mesophase content, on the other hand, require relatively longer heat treatment at somewhat lower temperatures to render them infusible.

A minimum temperature of at least 250° C. is generally necessary to effectively thermoset the fibers. Temperatures in excess of 500° C. may cause melting and/or excessive burnoff of the fibers and should be avoided. Preferably, temperatures of from about 275° C. to about 390° C. are employed. At such temperatures, the required amount of thermosetting can usually be effected within from about 5 minutes to less than about 60 minutes.

After the fibers have been thermoset as required, they are heated under a compressive pressure to a temperature sufficiently elevated to cause the mesophase pitch in the unoxidized interior portions of said fibers to undergo liquid flow and exude through surface pores or flaws in the fibers, e.g., at a temperature of from about 400° C. to about 700° C. During such heating, small droplets of pitch appear at intervals along the fiber lengths and come into contact with the surfaces of the adjacent fibers. By applying pressure to the web during such heating so as to effect greater contact between the fibers, this bleeding effect can be conveniently utilized to bond the fibers together. When the web is then further heated to a carbonizing temperature in an oxygen-free atmosphere so as to expel hydrogen and other volatiles and produce a carbon body, infusible carbon bonds are formed between the fibers and an integral, cohesive, self-bonded mass is produced.

The extent to which the pitch will bleed or exude through the surface of the fibers depends, of course, upon the degree to which the fibers have been thermoset. By controlling the areal density of the web and the degree of thermosetting which the fibers are permitted to undergo, it is possible to produce a wide variety of final products. Thus, when the web has a relatively high areal density and the fibers are thermoset to an extent which will allow only very limited flow of the unoxidized, internal pitch during heat treatment, the final product has the appearance of a loose, fluffy, low density blanket. Denser, better-bonded materials resembling felt, fiber-board and paper can be produced from webs which have been thermoset to a somewhat lesser extent so as to permit more extensive bleeding of internal pitch, with the exact product produced also depending upon the areal density of the web employed. By way of illustration, by thermosetting webs having an areal density of from about 0.05 kg./m.$^2$ to about 0.5 kg./m.$^2$ to an oxygen content of from about 1 percent to about 3 percent, a paper-like product can be obtained. When webs having an areal density of from about 0.8 kg./m.$^2$ to about 8.0 kg.m.$^2$ are thermoset to an oxygen content of from about 3 percent to about 5 percent, a product resembling a stiff fiberboard is obtained, while a felt-like material is obtained from webs having an areal density of from about 0.05 kg./m.$^2$ to about 8.0 kg./m.$^2$ which have been thermoset to an oxygen content of from about 4 percent to about 6 percent. Products of greater thickness and stiffness are obtained as the areal density of the webs increases. If necessary, a number of webs may be superimposed upon each other to increase the areal density. When the oxygen content exceeds about 6 percent, essentially unbonded webs are formed. While these webs have some strength due to mechanical entanglement of the fibers, no bonding exists between the fibers because no bleeding occurs during the heating process.

In order to effect greater contact between the fibers so as to facilitate bonding of the fibers by the pitch which exudes from the fibers, a compressive pressure is applied to the web during the heat treatment. Generally pressures of from about 0.1 kPa to about 5 kPa are sufficiently for this purpose.

Upon further heating, the fibers are eventually rendered totally infusible, and upon heating to a carbonizing temperature, e.g., a temperature of about 1000° C., fibers having a carbon content greater than about 98 percent by weight are obtained. At temperatures in excess of about 1500° C., the fibers are substantially completely carbonized. Such heating should be conducted in an oxygen-free atmosphere, such as the inert atmospheres described above, to prevent further oxidation of the fibers.

Usually, carbonization is effected at a temperature of from about 1000° C. to about 2500° C., preferably from about 1500° C. to about 1700° C. Generally, residence times of from about 0.5 minute to about 60 minutes are employed. While more extended heating times can be employed with good results, such residence times are uneconomical and, as a practical matter, there is no advantage in employing such long periods. In order to ensure that the rate of weight loss of the fibers does not become so excessive as to disrupt the fiber structure, it is preferred to gradually heat the fibers to their final carbonization temperature.

In a preferred embodiment of the invention, the thermoset web is continuously transported through a carbonizing oven or an endless carbon cloth conveyor belt, i.e., on a belt consisting of either graphitic or non-graphitic carbon. Carbon cloth is particularly suitable for use as a conveyor belt in a carbonizing oven because of its strength, flexibility, and high tempeature resistance, as well as because it is soft, nonabrasive and nonreactive with the fibers of the web, and hence will not damage the web.

If desired, the carbonized web may be further heated in an inert atmosphere, as described hereinbefore, to a graphitizing temperature in a range of from above about 2500° C. to about 3300° C, preferably from about 2800° C. to about 3000° C. A residence time of about 1 minute is satisfactory, although both shorter and longer times may be employed, e.g., from about 10 seconds to about 5 minutes, or longer. Residence times longer than 5 minutes are uneconomical and unnecessary, but may be employed if desired.

The products produced in accordance with the invention can be used in a variety of applications, e.g., for high temperature insulation purposes. The blanket-like webs are particularly useful as reinforcing materials for producing composite structures. The paper-like webs are especially suitable for producing speaker cones such as are described in copending application Ser. No. 399,319, now U.S. Pat. No. 3,930,130.

EXAMPLES

The following example is set forth for purposes of illustration so that those skilled in the art may better understand the invention. It should be understood that it is exemplary only, and should not be construed as limiting the invention in any manner.

EXAMPLE 1

A commercial petroleum pitch was employed to produce a pitch having a mesophase content of about 64 percent by weight. The precursor pitch had a density of 1.25 Mg./m.$^3$, a softening temperature of 120° C. and contained 0.7 percent by weight quinoline insolubles (Q.I. was determined by quinoline extraction at 75° C.). Chemical analysis showed a carbon content of 93.8%, a hydrogen content of 4.7%, a sulfur content of 0.4%, and 0.1% ash.

The mesophase pitch was produced by heating the precursor petroleum pitch at a temperature of about 400° C. for about 15 hours under a nitrogen atmosphere.

After heating, the pitch contained 64 percent by weight quinoline insolubles, indicating that the pitch had a mesophase content of close to 64 percent. A portion of this pitch was then blow-spun by means of a spinnerette at a temperature of 380° C. to produce staple lengths of fiber approximately 25 mm. in length and 10 microns in diameter. The blow-spun fibers were deposited in intimately contacting relationship with each other on a wire mesh conveyor belt positioned beside the spinnerette by reducing the pressure behind the conveyor belt so as to draw the blow-spun fibers onto the belt. The fibers were allowed to collect on the belt until a fibrous web having an areal density of 0.1 – 0.3 kg./m.$^2$ of belt surface accumulated.

The fibrous web produced in this manner was then transported on the conveyor belt through a 12-meter long forced-air convection oven at a speed of 1 meter/minute. The oven contained eight zones, each 1.5 meters in length, and the web was gradually heated from 175° C. in the first or entrance zone to 350° C. in the eighth or exit zone while air was passed downward through the web and conveyor belt at a velocity of about 2 meters/ minute. The oxygen content of the fibers was increased to 4.3 percent as a result of this procedure.

The thermoset fibrous web was then cut into 250 mm. by 280 mm. sections, and 8 of these sections were stacked on top of one another in parallel fashion between two similarly sized graphite plates. The stacked webs were then subjected to a compressive pressure of 2 kPa while they were heated under nitrogen to a temperature of 1600° C. over a period of 60 minutes where the temperature was maintained for an additional 60 minutes.

The resulting carbonized webs were found to be completely self-bonded and could be freely handled without loss of fibers. The webs were 6 mm. thick, and had a bulk density of 0.3 Mg./m.$^3$, appreciable stiffness characteristics of fiberboard, and maintained their shape well when handled.

When a single web having an areal density of 0.1–0.3 kg./m.$^2$ was thermoset to an oxygen content of only 1.8 percent and carbonized in the same manner, a dense, paper-like material was obtained.

What is claimed is:

1. A process for producing self-bonded webs of non-woven carbon fibers which comprises spinning carbonaceous pitch fiber from a nonthixotropic carbonaceous pitch having a mesophase content of from 40 percent by weight to 90 percent by weight, which mesophase content, under quiescent conditions, forms homogenous bulk mesophase having large coalesced domains; disposing staple lengths of the spun fiber in intimately contacting relationship with each other in a non-woven fibrous web; heating the web produced in this manner in an oxidizing atmosphere for a time sufficient to thermoset the surfaces of the fibers of the web to an extent which will allow the fibers to maintain their shape upon heating to more elevated temperatures but insufficient to thermoset the interior portions of the fibers; heating the web containing the externally thermoset fibers under compressive pressure in an oxygen-free atmosphere to a temperature sufficiently elevated to cause the mesophase pitch in the unoxidized interior portions of the fibers to undergo liquid flow and exude through the surfaces of the fibers and contact the surfaces of the adjacent fibers; and further heating the web to a carbonizing temperature in an oxygen-free atmosphere to produce a carbon body wherein the fibers are bonded to each other by infusible carbon bonds.

2. A process as in claim 1 wherein the staple fiber lengths are produced by blow-spinning of the pitch, and the blow-spun fibers are disposed into a web directly from the spinnerette.

3. A process as in claim 2 wherein the blow-spun fibers are disposed in a web on an endless wire mesh conveyor belt by reducing the pressure behind the belt so as to draw the blow-spun fibers onto the belt.

4. A process as in claim 3 wherein the web is transported on the wire mesh conveyor belt through an oxidizing atmosphere wherein thermosetting of the surfaces of the web fibers is effected.

5. A process as in claim 4 wherein the thermosetting is effected in a convection oven in which the oxidizing atmosphere is circulated downward through the web and wire mesh conveyor belt, and in which the web is gradually heated to the desired oxidizing temperature in a plurality of heating zones having progressively higher temperatures.

6. A process as in claim 5 wherein the thermoset web is transported on an endless carbon cloth conveyor belt through an oxygen-free atmosphere wherein the web is further heated and carbonized.

7. A process as in claim 5 wherein the oxidizing atmosphere is air.

8. A process as in claim 7 wherein the thermoset web is transported on an endless carbon cloth conveyor belt through an oxygen-free atmosphere wherein the web is further heated and carbonized.

9. A process as in claim 3 wherein the blow-spun fibers are deposited on the wire mesh conveyor belt to produce a web having an areal density of about 0.05 kg./m.$^2$ to about 0.5 kg./m.$^2$.

10. A process as in claim 9 wherein the web is transported on the wire mesh conveyor belt through an oxidizing atmosphere wherein the fibers of the web are oxidized to an oxygen content of from 1 percent by weight to 6 percent by weight.

11. A process as in claim 10 wherein thermosetting is effected in a convection oven in which the oxidizing atmosphere is circulated downward through the web and wire mesh conveyor belt, and in which the web is gradually heated to desired oxidizing temperature in a plurality of heating zones having progressively higher temperatures.

12. A process as in claim 11 wherein the thermoset web is transported on an endless carbon cloth conveyor belt through an oxygen-free atmosphere wherein the web is further heated and carbonized.

13. A process as in claim 11 wherein the oxidizing atmosphere is air.

14. A process as in claim 13 wherein the thermoset web is transported on an endless carbon cloth conveyor belt through an oxygen-free atmosphere wherein the web is further heated and carbonized.

15. A process as in claim 9 wherein the web is transported on the wire mesh conveyor belt through an oxidizing atmosphere wherein the fibers of the web are oxidized to an oxygen content of from 1 percent by weight to 3 percent by weight.

16. A process as in claim 15 wherein thermosetting is effected in a convection oven in which the oxidizing atmosphere is circulated downward through the web and wire mesh conveyor belt, and in which the web is gradually heated to the desired oxidizing temperature in a plurality of heating zones having progressively higher temperatures.

17. A process as in claim 16 wherein the thermoset web is transported on an endless carbon cloth conveyor belt through an oxygen-free atmosphere wherein the web is further heated and carbonized.

18. A process as in claim 16 wherein the oxidizing oven is air.

19. A process as in claim 18 wherein the thermoset web is transported on an endless carbon cloth conveyor belt through an oxygen-free atmosphere wherein the web is further heated and carbonized.

* * * * *

UNITED STATES PATENT OFFICE

CERTIFICATE OF CORRECTION

Patent No. 4,032,607 Dated June 28, 1977

Inventor(s) David Arthur Schulz

It is certified that error appears in the above-identified patent and that said Letters Patent are hereby corrected as shown below:

Column 1, line 30, "of" should read --to--.

Column 1, line 40, "oxygenfree" should read --oxygen-free--.

Column 1, line 60, quotation marks should appear about the word "mesophase".

Column 2, line 17, after "oriented" insert --domain--.

Column 2, line 38, quotation marks should appear about the word "mesophase".

Column 2, line 39, quotation marks should appear about the words "mesophase pitches".

Column 2, line 44, quotation marks should appear about the word "mesophase".

Column 3, line 7, "boudaries" should read --boundaries--.

Column 4, line 39, "preformed" should read --preferred--.

Column 4, line 47 "Acenaphyhy-" should read --Acenaphthy-"--.

Column 6, line 13, "fully" should read —full--.

Column 6, line 20, "blow-spin" should read --blow-spun--.

Column 7, line 17, "utilizing" should read --utilized--.

Column 7, line 40, "processively" should read --progressively--.

Column 9, line 7, "kg. $m.^2$" should read --kg./$m.^2$--.

UNITED STATES PATENT OFFICE

CERTIFICATE OF CORRECTION

Patent No. 4,032,607 Dated June 28, 1977

Inventor(s) David Arthur Schulz

It is certified that error appears in the above-identified patent and that said Letters Patent are hereby corrected as shown below:

Column 9, line 28, "sufficiently" should read --sufficient--.

Column 9, line 53, "or" should read --on--.

Column 11, line 3, "characteristics" should read --characteristic--.

Column 11, line 16, "homogenous" should read --homogeneous--.

Column 12, line 22, after "to" insert --the--.

Signed and Sealed this

Thirtieth Day of May 1978

[SEAL]

Attest:

RUTH C. MASON
Attesting Officer

LUTRELLE F. PARKER
Acting Commissioner of Patents and Trademarks